United States Patent [19]

Espenscheid

[11] Patent Number: 4,522,626

[45] Date of Patent: Jun. 11, 1985

[54] PROCESS FOR TREATING HIGH-SULFUR CAKING COALS TO INACTIVATE THE SULFUR AND ELIMINATE CAKING TENDENCIES THEREOF

[75] Inventor: Wilton F. Espenscheid, DeSoto, Tex.

[73] Assignee: Mobil Oil Corporation, New York, N.Y.

[21] Appl. No.: 265,291

[22] Filed: Jul. 21, 1981

Related U.S. Application Data

[63] Continuation-in-part of Ser. No. 163,081, Jun. 26, 1980, abandoned, which is a continuation of Ser. No. 001,665, Jan. 8, 1979, abandoned.

[51] Int. Cl.[3] ..... C10L 9/02; C10L 9/12

[52] U.S. Cl. ..... 44/1 R; 44/15 R; 201/17

[58] Field of Search ..... 44/15 R, 1 R; 201/17

[56] References Cited

U.S. PATENT DOCUMENTS

| | | | |
|---|---|---|---|
| 3,640,016 | 2/1972 | Lee et al. | 44/1 SR |
| 3,824,084 | 7/1974 | Dillon et al. | 44/1 SR |
| 4,054,420 | 10/1977 | Loganbach | 44/1 SR |
| 4,095,955 | 6/1978 | Stambaugh et al. | 44/1 SR |
| 4,097,244 | 6/1978 | Burk, Jr. et al. | 44/1 SR |
| 4,111,755 | 9/1978 | Bane et al. | 201/17 X |
| 4,118,201 | 10/1978 | Yan | 44/1 SR |
| 4,204,843 | 5/1980 | Neavel | 44/1 SR |
| 4,213,765 | 7/1980 | Wilson | 44/1 SR |
| 4,234,319 | 11/1980 | Beeson | 44/1 SR |

*Primary Examiner*—Carl F. Dees

*Attorney, Agent, or Firm*—Alexander J. McKillop; Michael G. Gilman; Charles J. Speciale

[57] ABSTRACT

A one or two-step process of treating high-sulfur caking coals for desulfurization, elimination of caking tendencies and incorporation of gasification catalyst thereon prior to steam- or hydrogasification thereof, or its use as a boiler fuel. In the one step process the coal is subjected to an aqueous lime/$O_2$ (or air) treatment under controlled conditions of time, temperature and pressure to accomplish the foregoing, whereas in the two-step process the coal is first treated with oxygen or air in dilute alkaline slurry at elevated temperature and pressure to remove the sulfur and then treated with a lime slurry, under controlled temperature conditions to incorporate the catalytic inducing lime.

21 Claims, 2 Drawing Figures

C01665

PROCESS FOR TREATING HIGH-SULFUR CAKING COALS TO INACTIVATE THE SULFUR AND ELIMINATE CAKING TENDENCIES THEREOF

CROSS REFERENCE TO RELATED APPLICATIONS

This application is a continuation-in-part of U.S. application Ser. No. 163,081, abandoned filed June 26, 1980 and now abandoned, which is in turn a continuation of U.S. application Ser. No. 001,665, filed Jan. 8, 1979 and now abandoned.

BACKGROUND OF THE INVENTION

1. Field of the Invention

This invention relates to a one or two-step process of treating high-sulfur caking coals for desulfurization, elimination of caking tendencies and incorporation of a gasification catalyst therewith.

2. Description of the Prior Art

The United States has an ample supply of coal to meet energy demands for several centuries, and many processes have been proposed for utilizing this enormous resource. In some, the coal is partially gasified in steam and/or oxygen (1–5) or hydrogen (6,7) to produce combustible gases, while others use the coal primarily as a boiler fuel. A large portion of the available coal, however, is not amenable to direct utilization because it is high in sulfur or caking, or frequently, both.

High-sulfur coals present a serious problem because Federal regulations impose restrictions on the amounts of $SO_x$ that can be emitted per M BTU of energy value. Thus fuel gases must be cleaned of $H_2S$ before combustion, or the stack gases must be scrubbed of $SO_x$ after combustion, while the combustion gases from chars or coals used as boiler fuels must also be scrubbed, or the coals must be cleaned prior to use.

Coal may be cleaned by either mechanical or chemical means. In mechanical cleaning of coal, the coal is crushed, sieved, and roughly sorted in largely inorganic pyrite ($FeS_2$) and carbonaceous matter by physical properties. This removes roughly half of the sulfur (the inorganic pyrite), along with a considerable loss in BTU values because of poor mechanical spearation. Chemical means, such as the Meyer's Process (8), chemically oxidize the inorganic sulfur to sulfate and free sulfur:

$$FeS_2+4.6Fe_2(SO_4)_3+4.8H_2O \text{---} FeSO_4+4.8H_2SO_4+0.8S$$

$$2.4O_2+9.6FeSO_4+4.8H_2SO_4 \text{---} 4.8Fe_2(SO_4)_3+4.8H_2O$$

Caking coals present an altogether different type of problem than do high-sulfur levels. Under mild heating, caking coals clump, stick together, or agglomerate into a mass that is difficult to move, handle, or process. Thus, most processes partially oxidize caking coals to provide a non-sticking exterior prior to gasification, even if the coal is subsequently to be used in a hydrogasifier where hydrogen consumption is an important process variable.

Gasification processes have been found to be more favorable if inorganic promotors, or catalysts, are added to the coal. These include such materials as alkali metal carbonates, lime, iron salts, or even coal ash itself. Generally, they are dissolved or slurried in water and mixed with the coal and dried before gasification.

SUMMARY OF THE INVENTION

In accord with the invention a one or two-step process of treating high-sulfur caking coals for sulfur-inactivation, elimination of caking tendencies and incorporation of gasification catalyst therewith, has been found which is a definite advance in the ever-present energy crisis.

In the one step process the coal is subjected to an aqueous lime/$O_2$ (air) treat under controlled conditions of time, temperature and pressure and simply dried for ultimate use. In the two-step process, the coal is initially treated with oxygen or air in dilute alkaline slurry at elevated temperatures and pressure (to remove the sulfur), then treated with a lime slurry, under controlled temperature conditions (to incorporate the catalytic lime) and similarly simply dried for further use. No washing is necessary in either case to remove the $CaSO_4$ which forms because its high stability prevents it ($CaSO_4$) from yielding $SO_4$ or $H_2S$ to gases resulting from either gasification or ordinary burning as a boiler fuel. It is the reaction products of the one step and two step processes that are catalytic.

DESCRIPTION OF THE PREFERRED EMBODIMENTS

Figure 1:
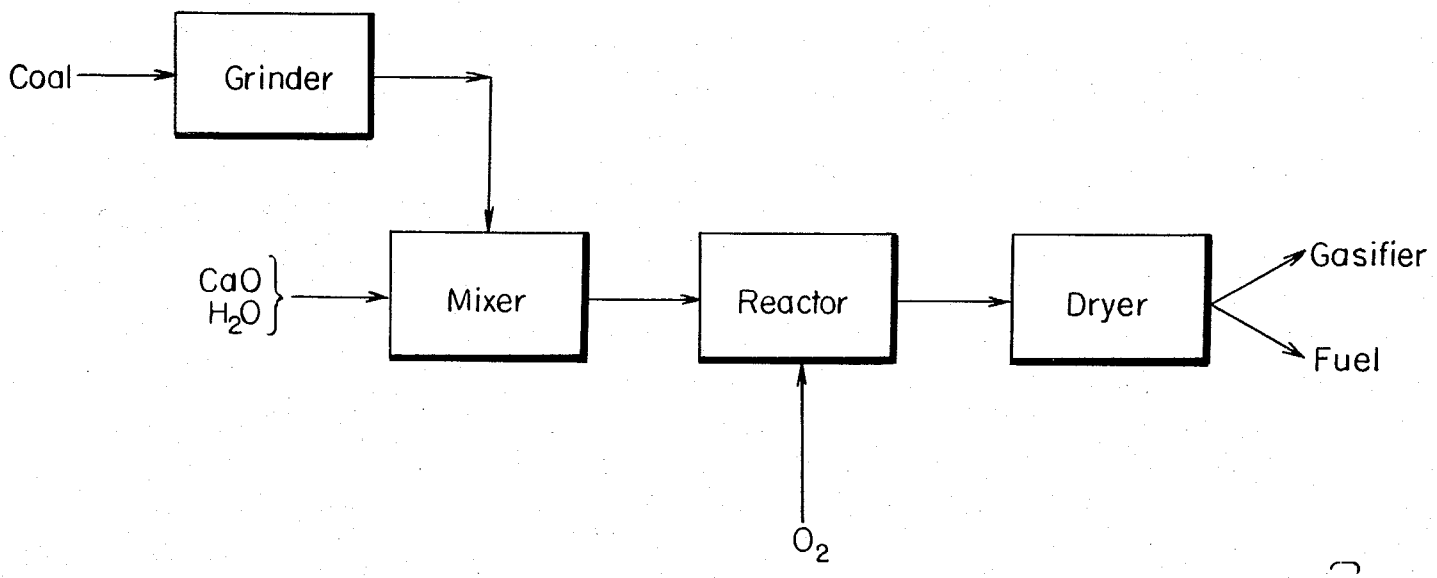
FIG. 1 is a flow diagram showing the sequence of the one-step process.

As indicated in FIG. 1, high-sulfur caking coal is ground to less than ¼" in diameter and fed to a mixer where it is combined with a slurry of lime in water (0.2 to 20% CaO/coal). The mixture is then pumped to a high pressure reactor where it is brought to 100°–300° C. and pressurized with air or oxygen at 100–1000 psig, and held at these conditions from 15 minutes to 2 hours. The coal is then dried for further use.

This simple operation produces several beneficial results:

(a) Nearly all of the pyritic sulfur and 15–40% of the organic sulfur is oxidized in the caustic medium and precipitated as calcium sulfate.

(b) The excess lime impregnates the now "activated" coal to produce an active coal for gasification or hydrogasification.

(c) Mild oxidation on the surface of the coal makes the coal non-caking and the minor amounts of carbonate formed from the oxidation react with lime to precipitate $CaCO_3$, which is an active gasification catalyst, on the coal.

In the foregoing one-step process, sparingly soluble alkaline materials are useful, i.e. alkaline earth oxides, cabonates, hydroxides, singly or in combination. Transition metal (Group VIII) oxides may be beneficially combined with the above.

Figure 2:
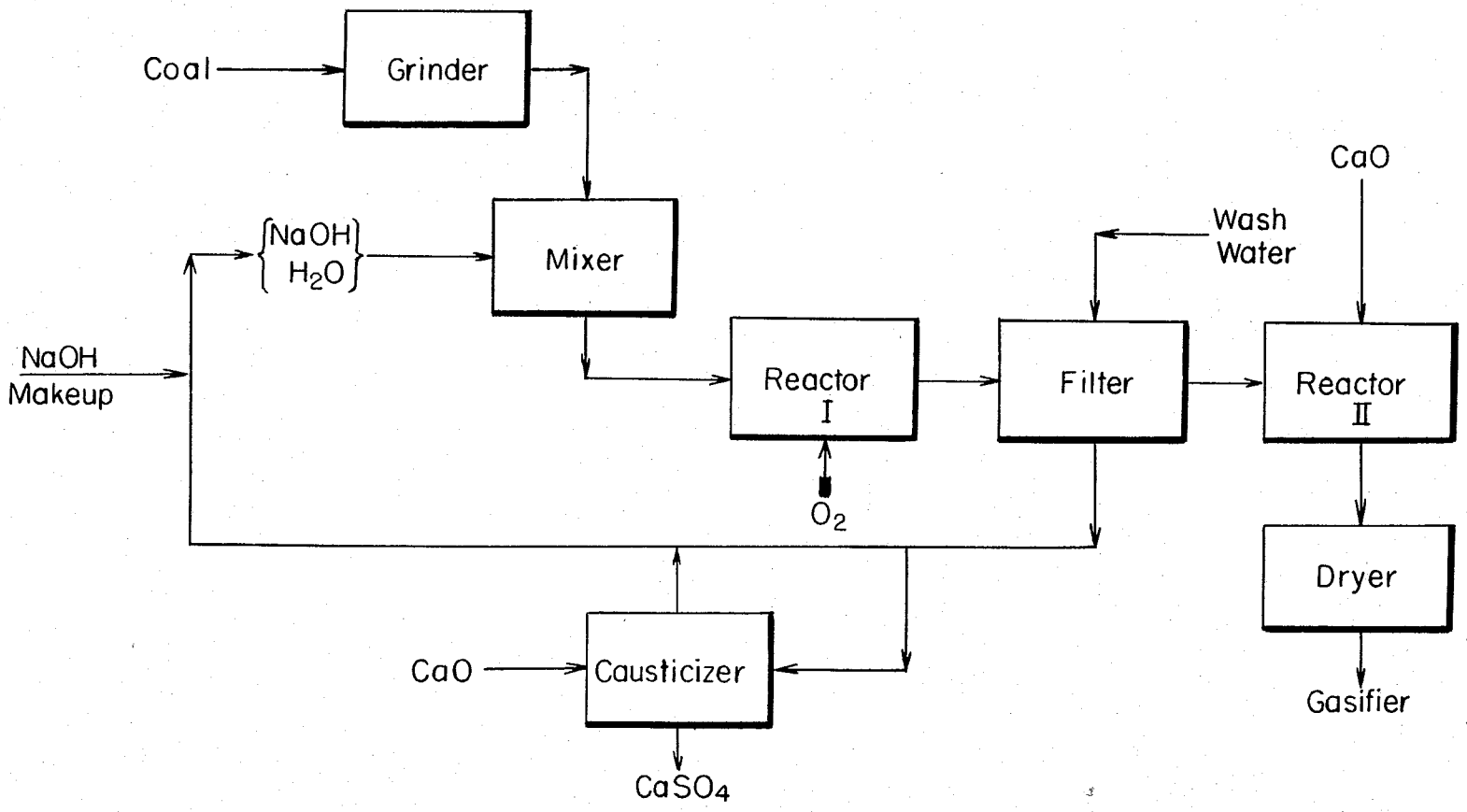
FIG. 2 is a flow diagram showing the sequence of he two-step process.

In the other modification of the invention, coal is treated in two steps (prior to gasification with either steam or $H_2$) to produce a low-sulfur, non-caking, catalyst-impregnated gasifier feed. As indicated in FIG. 2, the coal is crushed or ground to less than ¼" in diameter (preferably—30/50 mesh) and mixed with 0.2 to 3.0 molar NaOH and up to about 50% by volume of coal in the slurry. The mixture is then pumped under pressure into a stirred reactor, brought to 100°-300° C. (preferably 150°-200° C.), and pressurized with air or oxygen at 100-1000 psig (preferably 250-500 psig), and held at these conditions for 15 minutes to 2 hours (preferably 25-40 minutes). The chemical reactions taking place in the first reactor are postulated (but not bound by) the following:

1. Desulfurization $$FeS_2+4NaOH+15/4O_2 \text{ — — — } 2Na_2(SO_4)+Fe(OH)_3+\tfrac{1}{2}H_2O$$

$$\text{Coal-S}+\text{Oxygen} \text{ — — — } \text{Coal*(Activated)}+SO_4^{-2}$$

2. Oxidative De-caking $$\text{Coal}+\text{Oxygen} \text{ — — — } \text{Coal(non-caking)}+Co_x.$$

This first reactor imparts several important features to the coal:

(a) Nearly all of the inorganic (pyritic) sulfur and 15-40% of the organic sulfur is converted to soluble sulfates (b) The caustic, while removing inorganic matter and organic sulfur, prepares the coal for catalyst impregnation in the second reactor.

(c) The oxidative conditions eliminate the agglomerating tendency of the coal.

The coal leaving the first reactor is filtered, lightly washed, and the wash is returned to the mixer. A slipstream is causticized with lime to remove sulfates and restore pH. The coal is mixed with lime slurry in the second reactor at 150° C.-300° C. (preferably 200°-250° C.), at a CaO/coal ratio of 0.02 to 0.20 wt/wt (preferably 0.05-0.10). The second reactor chemically and physically impregnates the coal with gasification catalyst:

$$\text{Coal*(activated)}+CaO\text{(excess)}+H_2O \text{ — — — } \text{Coal(Ca-catalyst impregnated)}+Ca(OH)_2\text{(excess)}.$$

The coal is then dried and used in the desired gasification process.

In the foregoing two-step process, oxidation of inorganic (and organic) sulfur is promoted by bases in the first-step, in this case soluble bases, i.e., alkali metals (NaOH, KOH), less preferably, $NH_3$. In the second-step alkaline earth oxides, carbonates, or hydroxides are useful, singly or in combination. It is conceivable that transition metal (Group VIII) oxides, hydroxides, or carbonates could also be added.

While it has been known to impregnate coals for use in gasification processes and to $NaOH/O_2$ treat boiler fuel coal to remove pyrite therefrom, it has not been known to employ the present one-step $CaO/O_2$ process to inactivate sulfur and impregnate gasification catalyst into coal (without separation of the sulfates). Non-caking sulfur-inactivated coal has been the goal of extensive research throughout the world. Now, a simple process that would elimiante expensive stack gas cleaning has been provided.

While it has also been known to oxygen/steam (8) and oxygen/$NH_3$(9) treat coal to remove inorganic sulfur therefrom prior to use as a boiler fuel and to employ NaOH/CaO mixtures to incorporate catalysts into coal for gasification, but not with $O_2$ for desulfurization, it has not been known to employ the present two-step $O_2$/NaOH process to desulfurize and pre-treat the coal to subsequently accept the CaO catalyst for gasification. Thus, by this invention high-sulfur, caking coals, that otherwise would be unacceptable for gasification can be used, while steam and hydrogasification are concurrently increased.

As earlier mentioned, it is the reaction products formed by the treatment in the one and two step processes, aforedescribed, that are catalytic. It is not precisely known what they are, but the catalytic effect is known.

References

1. Hydrocarbon Processing, Gas Processing Handbook, April, 1975, page 119.
2. ibid, p. 124.
3. ibid, p. 125.
4. ibid, p. 126
5. ibid, p. 128.
6. ibid, p. 122.
7. ibid, p. 123.
8. 173rd ACS, Div. Fuel Chemistry, Mar. 21-25, 1977, Vol. 22, #2, p. 100, S. Friedman, et al.
9. ibid, p. 93, S. S. Sareen.

In order to further illustrate the invention the following non-limitative examples are presented.

EXAMPLE 1

One-Step Process

High-sulfur caking coal is grouped to less than ¼" (see FIG. 1) and is fed to a mixer where it is combined with a slurry of lime in water 20% CaO/coal. The mixture is then pumped to a high pressure reactor (Reactor I) where it is brought to 150° C. and pressurized with air at 400 psig and held at these conditions for 45 minutes. The resultant coal product is dried at 80° C. for further use.

Substantially all of the inorganic (pyritic) sulfur and 20% of the organic sulfur was oxidized in the caustic medium and precipitated as calcium sulfate. The excess lime impregnated the now "activated" coal to 15%. Mild oxidation on the surface of the coal made the coal non-caking and minor amounts of carbonate formed from the oxidation reacted with the lime to precipitate calcium carbonate, which is an active gasification catalyst, on the treated coal.

EXAMPLE 2

Two-Step Process

In this example coal was treated in two-steps (prior to ultimate gasification with either steam or hydrogen) to produce a low-sulfur, non-caking catalyst-impregnated gasifier feed.

High-sulfur caking coal is ground to less than ¼" (see FIG. 2) 30/50 mesh, and mixed with 1.0 molar NaOH and up about 50% by volume of coal in the slurry. The mixture is then pumped under pressure into a stirred reactor, brought to 150° C., and pressurized with air at 400 psig and held at these conditions for 45 minutes. Substantially all of the inorganic (pyritic) sulfur and 30% of the organic sulfur is converted to soluble sulfates. The caustic, while removing inorganic matter and organic sulfur, pepared the coal for catalyst impregnation in the second reactor (Reactor II). The oxidative conditions substantially eliminated the agglomerating tendencies of the coal.

The coal leaving the first reactor is then filtered, washed, and the wash returned to the mixer. A slipstream is causticized with lime to remove sulfates. The coal is then mixed with lime slurry in the second reactor at 80° C., at a CaO/coal ratio of 0.20 wt/wt. The second reactor chemically and physically impregnated the coal with the gasification catalyst to an extent of 15%. The resultant coal product was then dried at 80° C. for further use (e.g. gasification process).

What is claimed is:

1. A process of treating high-sulfur, caking coals for deactivation of the sulfur, substantial elimination of the caking tendencies and incorporation of a catalyst therewith which comprises reducing the particle size of the high-sulfur, caking coal, and (a) subjecting the resultant coal to a slurry of lime at a lime/coal ratio between about 0.2 and 20%, (b) then subjecting the resulting mixture to air or oxygen treatment, at a temperature between about 100° and 300° C., at a pressure between about 100 and 1000 psig, and for a period of time between about 15 minutes and 2 hours, said catalyst being the resultant reaction product or products produced by steps (a) and (b).

2. A process according to claim 1 wherein the particle size of said coal is less than ¼", said temperature is between about 150° and 200° C., said pressure is between about 250 and 500 psig, and said period of time is between about 25 and 50 minutes.

3. A process of treating high-sulfur, caking coals for deactivation of the sulfur, substantial elimination of the caking tendencies and incorporation of a gasification or hydrogasification catalyst therewith which comprises the steps of:

reducing the particle size of the high-sulfur, caking coal, and (a) mixing the resultant coal with an alkaline solution;

(b) subjecting the resultant mixture to air or oxygen treatment at a temperature between about 100° and 300° C. at a pressure between about 100 and 1000 psig, and for a period of time between about 15 minutes and 2 hours, filtering and washing of the coal obtained thereof; and (c) subjecting the coal obtained by step (b) to a slurry of lime at a temperature between about 150° and 300° C., at a lime/coal ratio between about 0.02 and 0.2 wt/wt, said catalyst being the resultant reaction product or products produced by steps (a) and (b).

4. A process according to claim 3 wherein the particle size of said coal is less than ¼", said temperature of step (b) is between about 150° and 200° C., said pressure is between about 250 and 500 psig, and said period of time is between about 25 and 40 minutes, said temperature of step (c) is between about 200° and 250° C. and said lime/coal ratio is between about 0.05 and 0.10 wt/wt.

5. A process according to claim 2 wherein said particle size is between about 30 and 50 mesh.

6. A process according to claim 4 wherein said particle size is between about 30 and 50 mesh.

7. A process according to claim 4 wherein said alkaline solution comprises an aqueous alkali metal solution in amounts up to about 50% by volume of coal in the mixture.

8. A process according to claim 7 wherein said alkali metal solution further comprises about 0.2 to 3.0 molar sodium hydroxide.

9. A process of treating high-sulfur, caking coals for deactivation of the sulfur, substantial elimination of the caking tendencies and incorporation of a catalyst therewith which comprises:

(a) grinding the high-sulfur, caking coal to less than about ¼";

(b) subjecting the resultant ground coal to a slurry of lime in water in a mixer and subjecting that resulting mixture to air or oxygen treatment;

(c) transferring the resultant mixture of step (b) to a high pressure reactor at a pressure between about 100 and 1000 psig for a period of time between about 15 minutes and 2 hours, and (d) drying the resultant coal, said catalyst being the resultant reaction product or products produced by steps (b) and (c).

10. A process of treating high-sulfur, caking coals for deactivation of the sulfur, substantial elimination of the caking tendencies and incorporation of a gasification or hydrogasification catalyst therewith which comprises the steps of:

(1) grinding or crushing the high-sulfur, caking coal to less than about ¼", (a) mixing the resultant coal in a mixer with about 0.2 to 3.0 molar sodium hydroxide (aqueous) up to about 50% by volume of coal in the mixture, transferring the resultant mixture under pressure to a stirred reactor in the presence of air or oxygen at a temperature between about 100° and 300° C., at a pressure between about 100 and 1000 psig for a period of time between about 15 minutes and 2 hours, and (2) filtering and washing of the coal obtained by step (1), mixing the resultant washed coal with a slurry of lime in water in a second reactor at a temperature between about 150° and 300° C. at a lime/coal ratio between about 0.02 and 0.20 wt/wt, and drying the end product, said catalyst being the resultant reaction product or products produced by steps 1(a) and 2.

11. A process according to claim 10 wherein the resultant wash of step (2) is recycled to said mixer of step (1) and a slip-stream of same is causticized with lime to remove sulfates and restore pH of said wash.

12. The low-sulfur, non-caking coal produced by the process of claim 1.

13. The low-sulfur, non-caking coal produced by the process of claim 2.

14. The low-sulfur, non-caking coal produced by the process of claim 3.

15. The low-sulfur, non-caking coal produced by the process of claim 4.

16. The low-sulfur, non-caking coal produced by the process of claim 7.

17. The low-sulfur, non-caking coal produced by the process of claim 9.

18. The low-sulfur, non-caking coal produced by the process of claim 10.

19. A process of treating high-sulfur, caking coals for deactivation of the sulfur, substantial elimination of the caking tendencies and incorporation of a catalyst therewith which comprises reducing the particle size of the high-sulfur, caking coal, and (a) subjecting the resultant coal to a slurry of alkaline earth oxides, carbonates, hydroxides or mixtures thereof at a ratio/coal of between about 0.2 and 20%, (b) then subjecting the resulting mixture to air or oxygen treatment, at a temperature between about 100° and 300° C., at a pressure between 100 and 1000 psig, and for a period of time between about 15 minutes and 2 hours, said catalyst being the resultant reaction product or products produced by steps (a) and (b).

20. A process of treating high-sulfur, caking coals for deactivation of the sulfur, substantial elimination of the caking tendencies and incorporation of a gasification or hydrogasification catalyst therewith which comprises the steps of:

(a) reducing the particle size of the high-sulfur, caking coal, mixing the resultant coal with an alkaline solution;

(b) subjecting the resultant mixture to a temperature between about 100° and 300° C. at a pressure between about 100 and 1000 psig, and for a period of time between about 15 minutes and 2 hours, and (c) subjecting the coal obtained by step (a) to a slurry of alkaline earth oxides, carbonates, hydroxides or mixtures thereof, at ratio/coal between about 0.02 and 0.2 wt/wt, at a temperature between about 150° and 300° C., said catalyst being the resultant reaction product or products produced by steps (b) and (c).

21. A process according to claim 20 wherein said alkaline solution in step (a) is sodium hydroxide.

* * * * *